US008424503B1

(12) United States Patent
Harbert

(10) Patent No.: US 8,424,503 B1
(45) Date of Patent: Apr. 23, 2013

(54) ENCLOSED ROCKER ARM COVER ASSEMBLY FOR HEMI ENGINES HAVING INTERNAL MULTI-COIL MOUNTING STUDS

(76) Inventor: Richard H. Harbert, Mukilteo, WA (US)

( * ) Notice: Subject to any disclaimer, the term of this patent is extended or adjusted under 35 U.S.C. 154(b) by 925 days.

(21) Appl. No.: 12/539,352

(22) Filed: Aug. 11, 2009

(51) Int. Cl.
*F02B 77/00* (2006.01)

(52) U.S. Cl.
USPC ..... 123/195 C; 123/90.38; 123/647

(58) Field of Classification Search ..... 123/195 C, 123/188.14, 90.39, 90.38, 90.37, 594, 143 C, 123/143 R, 647, 638, 198 E
See application file for complete search history.

(56) References Cited

U.S. PATENT DOCUMENTS 5,323,745 A 6/1994 Sato et al.
6,494,193 B2 12/2002 Weingaertner et al.
6,622,711 B1 9/2003 Skinner et al.
7,350,488 B2 4/2008 Harbert
2002/0139344 A1* 10/2002 Kitada et al. ..... 123/195 C

* cited by examiner

*Primary Examiner* — Noah Kamen
*Assistant Examiner* — Hung Q Nguyen
(74) *Attorney, Agent, or Firm* — Jacques M. Dulin, Esq.; Innovation Law Group, Ltd.

(57) ABSTRACT

An improved hemi engine rocker arm cover assembly having an enclosed, dry upper coil chamber and an open bottom, lower, wet rocker arm chamber that includes special seal and flange members to seal it to the engine head. The fully enclosed upper coil chamber includes a plurality of pairs of staggered coil mounting bosses, one pair per coil, and paired igniter boot apertures, one pair per coil. For performance engines, dual boot coils are mounted on the bosses with the boots extending into the wet chamber for sealingly engaging the igniters. For standard engines, single boot coils are used, and one of each pair of boot apertures is sealed with a special plug.

13 Claims, 8 Drawing Sheets

ENCLOSED ROCKER ARM COVER ASSEMBLY FOR HEMI ENGINES HAVING INTERNAL MULTI-COIL MOUNTING STUDS

FIELD

The invention relates to the field of automotive parts, and more particularly to an improved rocker arm cover assembly having an upper coil chamber that is enclosed and a lower rocker arm chamber that includes special seal and flange members to isolate it from the engine head. The assembly is robust, and preferably machined from billet aluminum, but may be cast aluminum or plastic/synthetic compound materials. The fully enclosed upper coil chamber includes multiple pairs of raised bosses on each of which pairs a coil is mounted. The top plate of the lower rocker arm chamber includes pairs of plug lead apertures communicating between the two chambers for selective insertion of single plug discharge leads or dual plug discharge leads. The side wall of the upper coil chamber includes one or more apertures for pass-through of a single, gang power lead, or multiple, individual leads to the coils. Recessed grooves in the side walls provide clearance for sockets to access the mounting bolts around the assembly base mounting flange.

BACKGROUND

Conventional after-market valve covers or rocker arm covers (RACs) comprise a thin sheet metal or plastic cover mounted on the engine head(s). These covers have a single cavity that encloses the rocker arms, valve return springs and pushrods that together actuate the cylinder valve stems. In more recent model engines equipped with a Distributorless Ignition Systems (DIS), a plurality of ignition coils, one for each cylinder in the engine, are mounted in association with the head. For a typical V8 engine, two rocker arm covers are employed, one for each bank of 4 cylinders.

Several approaches have been tried for mounting of the coils in a manner to not interfere with the rocker arms. Weingaertner U.S. Pat. No. 6,494,193, for example, shows a stepped design for a straight-4 engine, wherein a large shallow-height plastic base case covers both the rocker arms and the spark plugs. There is a smaller elevated casing atop the base that contains the coils. Leads are embedded in the plastic and oil-proof boots are used to connect the leads to the plug. This approach suffers the serious disadvantage of requiring removal of 13 bolts to remove the base cover to access the plugs, and it is dedicated to single plug-fired cylinders.

Skinner U.S. Pat. No. 6,622,711 also uses a large cover over the plugs and a separate coil cassette (container) that fits within the large cover directly over the plugs. The coils connect to the plugs via boots as in Weingaertner. Although the engine is only shown schematically, and as a straight 4, the large cover is co-extensive with the head, so the coils are in the wet zone, albeit within a separate cassette. To access the coil cassette, 16 bolts and the large cover have to be removed.

Sato U.S. Pat. No. 5,323,745 shows a single, plastic rocker arm cover over dual camshafts and valve stems with an oil/gas separation chamber mounted on the underside of the cover. A coil arrangement is not disclosed, so it appears this patent is directed to a distributor-type ignition system.

Industrie Magneti Marelli in EP Application 0-512-357-A2 (11.11.92) provides "plug-top" ignition coils located in a 2-part housing comprising upper and lower flanged housings that are bolted together (apparently 16 bolts) at the flanges. The coils are located in the housing. Projecting from the bottom is a boot that fits over the spark plugs. The top housing includes 4 caps, each providing input lead access to the coil below. This unit is independent of a rocker arm cover and rides on the plugs themselves, rather than being separately mounted, so the unit puts weight and torsional strain on the plugs.

As can be seen from such exemplary unsatisfactory designs, there is a long felt but unmet need in the art for a cleaner, tidier rocker arm and coil cover assembly particularly suited to hemi-type engines, which can be selectively fitted with one or two spark plugs or fuel injectection igniters, is robust under severe service conditions, has a useful life far longer than stamped sheet metal or plastic, and is simple and faster to install.

THE INVENTION

Summary, Including Objects and Advantages

The invention is directed to an improved rocker arm cover (RAC) for hemi-type internal combustion engines, i.e., engines having hemispherical cylinder heads, including the HEMI® brand engines of the Chrysler Group, LLC. (herein "hemi" inclusively), and more particularly to an over-under design in which coils are placed in a separate, enclosed chamber above the rocker arms and the associated spark plugs or fuel injection igniters that extend above the engine heads. The exemplary rocker arm cover of this invention is described in reference to a 4-cylinder bank of a V-8 hemi engine, so that there are two complementary rocker arm covers employed for each such V-8 engine.

The inventive RAC comprises a single, generally elongated, stadium-shaped, open-bottom housing having a plurality of parts and features. In plan view, the housing is generally rectangular with rounded ends, classified as "stadium" shaped, and includes a longitudinal center line. In vertical cross-section the RAC housing is generally an inverted-U shape and has a generally horizontal partition wall spanning between the vertical side walls approximately half way between the top and the open bottom. The housing may be made of aluminum or a rugged plastic or composite composition, such as a carbon-fiber composite of the type used in automotive applications in conjunction with engine compartments. Although the inventive RAC can be made of cast aluminum, it is preferably machined from billet aluminum, and high strength aircraft aluminum can be used, such as Alcoa 7075-2 or 7140 aircraft aluminum.

The housing comprises an upper, coil chamber or lid, the bottom of which chamber is a solid transverse partition web that forms the top wall of the lower, rocker arm and ingniter chamber. The upper coil chamber is defined by a generally semi-circular or "D" shaped, concave-down, lid. The bottom margin of the side walls of the lid matingly engage the transverse web. This lid is secured to the bottom housing compartment by a pair of counter-sunk screws, located one at each end of the lid, and oriented vertically from the outer top of the lid. The bores for the screws are located along the longitudinal center line, each one adjacent opposite rounded ends of the RAC housing. Thus the lid can be removed for service access to the coil chamber independent of the rocker arm chamber, and without need to remove the inventive RAC assembly from the head.

The term "igniter" is used generically herein to refer either to spark plugs or to electronic igniters for fuel injected systems. The lower chamber housing is open at the bottom to fit over the engine head. The side wall of the lower chamber terminates in a lateral flange that includes a plurality of lateral, semicircular projections. These projections are bored to permit passage of mounting bolts to mount the housing assembly to the engine head. Thus, the inventive RAC is secured to the head via the flanges that extend outwardly of the housing. In an exemplary implementation, only ten mounting bolts are required to secure the RAC assembly to the head.

The exterior vertical wall of the housing is continuous and terminates at a lower margin having a groove that receives a seal member, which in a preferred embodiment is a flanged O-ring. Approximately half of that lower margin terminates in an internal, vertically downwardly extending lip, lying inside the O-ring seal, that engages a corresponding groove or shoulder of the engine head. That lip provides an alignment function that insures the inventive RAC is properly fitted on the head before the securing bolts are inserted and tightened.

In addition, the side wall of the upper coil chamber includes one or more apertures for pass-through of a single, gang power lead (e.g., four leads bundled in a gang that separates into four separate leads), or multiple, individual power leads for each of the four coils. Recessed grooves in the side walls provide clearance for sockets to access the mounting bolts that are spaced around the assembly base mounting flange.

The transverse horizontal web that divides the housing into the upper and lower chambers includes a plurality of mounting bosses projecting upwardly in the upper coil chamber. These bosses include threaded bores that receive screws for mounting the coils in the upper coil chamber. These bores do not reach into the lower rocker arm chamber. As noted above, in plan view, the inventive RAC assembly has a fore/aft longitudinal center line. The coil-carrying bosses are disposed staggered along and spaced laterally away from the center line, although not laterally equidistant from the center line. Since the coil bosses do not extend into the lower chamber there is clearance in the lower chamber for the rocker arms. The staggered relationship of the bosses permits securing each coil to an individual pair of bosses, generally one at each end of each coil. The coils are oriented generally with the power lead sleeve normal to the longitudinal center line of the RAC.

In addition the upper coil chamber includes pairs of adjacent vertical apertures in the transverse horizontal web. These apertures are grouped in closely spaced, adjacent pairs, disposed along, and bisected by, the longitudinal center line of the RAC assembly, not spaced on opposite sides of the center line. These apertures permit the igniter discharge leads from the coils to project into the lower chamber for connection to the igniters or plugs as the case may be. Each of the coils in the multiple coil assembly can be mounted in, or changed out from, the upper chamber of the RAC assembly without removing the head from the engine. These discharge lead apertures include raised rings on the top face of the transverse horizontal wall, and one or more concentric grooves on the bottom face of the transverse wall. The grooves of each pair of associated apertures merge in a generally "dog bone" or "FIG. 8" shape. These grooves engage grommet-type seals of the depending discharge leads.

It is an important aspect of the invention that the discharge lead apertures are provided in pairs. In standard hemi-type engines, each coil includes one discharge lead boot projecting downwardly into the lower chamber to engage one igniter. However, in performance engines, two igniters are used per cylinder. The performance coils have two discharge lead boots projecting downwardly into the lower chamber that connect with the two igniters in the engine head. In the case of the inventive RAC assembly being used for a standard hemi engine, one of the discharge lead apertures is plugged with an elastomeric plug that is pressed into the unused aperture of each pair. These plugs include laterally extending lips, top and bottom, that securely grip and seal to the respective top rings and bottom grooves described above.

In the preferred embodiment, the lid screws are adjacent opposite longitudinal ends of the RAC assembly, but may be medial thereof or additional screws may be used as one skilled in this engineering art deems advisable. Note that the lid is thus secured to the lower housing, which in turn is secured to the head along the outside margins of the RAC assembly. As a result, the lid can be removed and the coils serviced or changed-out without having to disturb the bottom seal of the rocker arm chamber.

The upper coil chamber also includes a single power supply aperture in a longitudinal side wall of the lid. Preferably this aperture is medial of the ends and is located on the lid wall facing the center line of the engine. A common power feed for all four coils is supplied through the sidewall aperture. Since the lower rocker arm chamber is isolated, the power supply aperture need not be fully sealed. However, it is preferred to provide a soft grommet to seal the aperture margin to reduce or prevent infiltration of dust, grime, etc.

The inventive RAC units may be identical for the left and right banks of cylinders, or they may be mirrored, that is, chiral orientation of the parts with respect to each other. Stated another way, there may be a Left handed RAC and a Right handed RAC, so that the aperture(s) for the input coil power supply are oriented one toward the front, and one toward the back of the RAC as installed on the engine heads. Preferably the RAC units are identical, with the input coil power supply aperture is between the first and second vertical socket grooves so that the power supply leads to the banks are very close to the transverse centerline of the engine, thus not requiring significant variations in the length or orientation of the wiring harness. That is, the wiring harness for left and right banks can be identical, which is highly beneficial in terms of simplification of construction, stocking and assembly. Only a single version of the power supply harness is required, rather than two distinct versions.

An important aspect of the inventive RAC assembly is the provision of the parting (join) line between the lid and the lower rocker arm chamber is below the input coil power supply line aperture(s). In this way, the lid can be lifted off and individual coils can be inspected or replaced without unthreading and rethreading of the feed wires of the other coils. This "lift-off" for service functionality is an important feature of the split chamber design of the inventive RAC assembly.

Accordingly, the inventive RAC includes multiple functionalities that cooperate to provide complete, but independent access to the various engine parts needing service or replacement independent of each other, with each isolated from the others. The coil cover can be taken off and one or more individual coils serviced or replaced, without removing the rocker arm housing from the head. Or the housing can be removed to access the rocker arms and plugs without disturbing the coil layout.

BRIEF DESCRIPTION OF THE DRAWINGS

The invention is described in more detail with reference to the seven sheets of line drawings, in which.

DETAILED DESCRIPTION, INCLUDING THE BEST MODES OF CARRYING OUT THE INVENTION

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

All publications, patents and applications cited in this specification are herein incorporated by reference as if each individual publication, patent or application had been expressly stated to be incorporated by reference.

Figure 1:
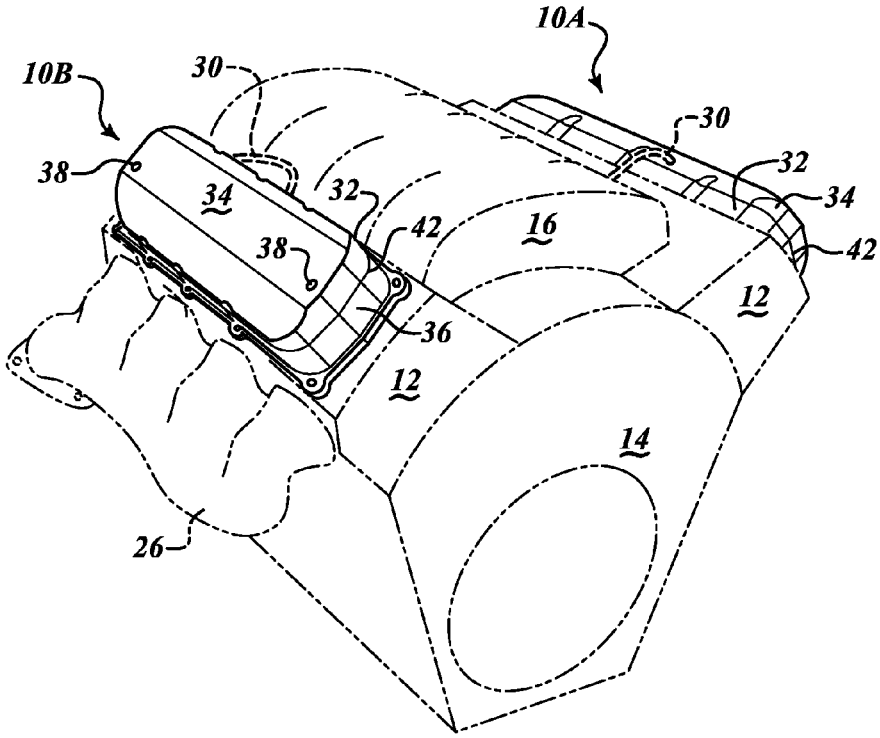
FIG. 1 is an isometric view from the front right side of an engine showing two inventive RAC assemblies in use context as mounted on the two heads of a V8 engine.

FIG. 1 shows in isometric a pair of the inventive RAC assemblies 10A, 10B in their use context mounted on the heads 12 of a V8 engine 14 on either side of the air intake manifold 16 and above the exhaust manifold 26. The coil power supply and ground wire input lead 30 is shown feeding into the inboard side of the each respective inventive RAC assembly 10A, 10B. As shown, the two RAC assemblies are identical, with the power supply lead entering the RAC assemblies, one fore and one aft of a transverse center line of the RAC assembly, respectively.

Each inventive RAC assembly 10 comprises a generally rectangular housing having a continuous vertical side wall 32 that is rounded at each end 54 (better seen in FIG. 2) to form, in plan view, a stadium shape. The vertical side wall 32 has a horizontal parting line 42 that divides the RAC into a lid 34 that fits over the lower body 36. The lid is secured to the main body by recessed or counter-sunk flush, threaded fasteners 38 that pass through holes 88 adjacent each end wall 54 to the lower body 36.

Figure 2:
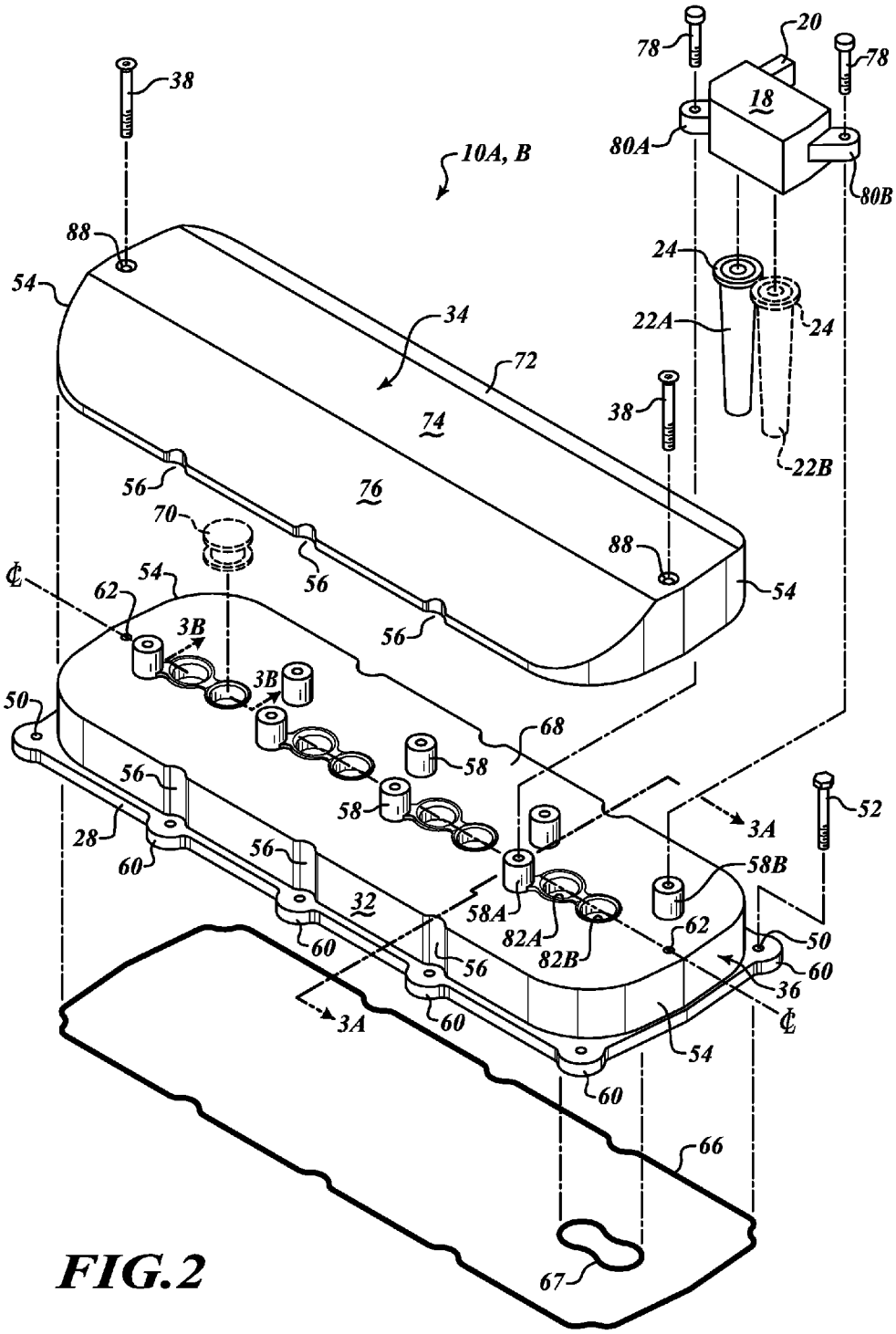
FIG. 2 is an exploded isometric view from the outboard side of the inventive RAC assembly showing the four pairs of coil mounting studs and dual spark plug boot apertures in the horizontal top face of the lower rocker arm chamber.

FIG. 2 shows in exploded isometric, view all of the parts of the inventive RAC assembly 10B of FIG. 1 by way of example. In addition to the parts called out above it can be seen that the coils 18 (only one shown for view clarity) are secured to the threaded bosses 58A, 58B by screws 78 passing through holes in ears 80A, 80B, 2 per coil. Note the bosses are staggered, one on each side of the center line CL, but are assymetric in this embodiment, one (58A) closer to the CL and the other (58B) spaced laterally farther from the CL. One skilled in the art will recognize that the mounting bosses and boot aperture spacing and location may be varied to accommodate various designs of coils, or conversely, coils dimensioned and mounting ears located on different types of coils to accommodate the boss and aperture locations of the RAC.

The coil power supply input lead bundle 30 (FIG. 1) terminates in one wire per coil via the coil nozzle 20. The coil output is provided to igniter(s) (not shown) via boots 22A, 22B that project through apertures 82A, 82B in the horizontal transverse partition wall 68 that defines the two chambers of lid 34 and lower body 36. The coil output leads are embedded in the center vertical axis of the boots 22, the bottom cones of which surround and seal off the igniters from the oil-wet environment of the rocker arm chamber. Boot flanges 24 are configured on their lower surface to engage the sealing grooves or/and lip configuration 84 that surrounds the apertures 82A, 82B in a figure-8 pattern. It should be understood that the boot flange 24 preferably fits on the top of the transverse horizontal partition wall in grooves/lip 84, or may press upwardly against the underside (best seen in FIG. 7) of the partition wall, depending on the boot configuration. Further, the boots may be integral with the coils. In addition, a figure-8 flanged seal member 67 fits in groove 84 on the underside of the transverse horizontal partition wall 68 to seal against the side walls of the boots 22A, 22B (best seen in FIG. 3B). Where the hemi engine is configured for performance to include two igniters per cylinder, the coil has two boots as shown. For standard engines, only one boot with output lead is used, and the extra boot aperture hole 82 is plugged with a grommet-type solid plug 70 (on the left in FIG. 2).

The two lid screws 38 are fitted through holes adjacent the lid ends and secured into the threaded holes 62 in the lower body 36; only 2 screws are needed. Since the lid can be removed for access to the upper dry coil chamber (defined by the lid 34 and partition wall 68), without disturbing the wet rocker arm chamber below it (defined by the lower body 36), the coils can be serviced independently of the rocker arms and the igniters. In the embodiment shown, no seal member is required along the parting line 42 between the lid 34 and the lower body 36, as the surfaces are precisely milled and fit tightly. However, a flat, resilient seal or gasket may be provided, if desired, or environmental use conditions require (e.g., extreme dust or water).

The assembled RAC unit 10 is secured to the head of the engine via bolts 52 passing through holes 50 provided in ears 60 of the lower mounting flange 28. Clearance grooves 56 are provided in the side walls of both the upper lid 34 and the lower body 36 to permit sockets to access the heads of the securing bolts 52. The lower marginal edge of the lower body 36 includes a flanged, continuous, marginal sealing ring 66 that is received in a corresponding groove 86 (not shown in this view, best seen in FIG. 3). In the case of a standard hemi engine where the coils provide output to only one igniter, and hence have only one boot, a plug 70, of the grommet type which includes flanges to engage the grooves 56, is provided to seal the second aperture 82B.

Figure 3A:
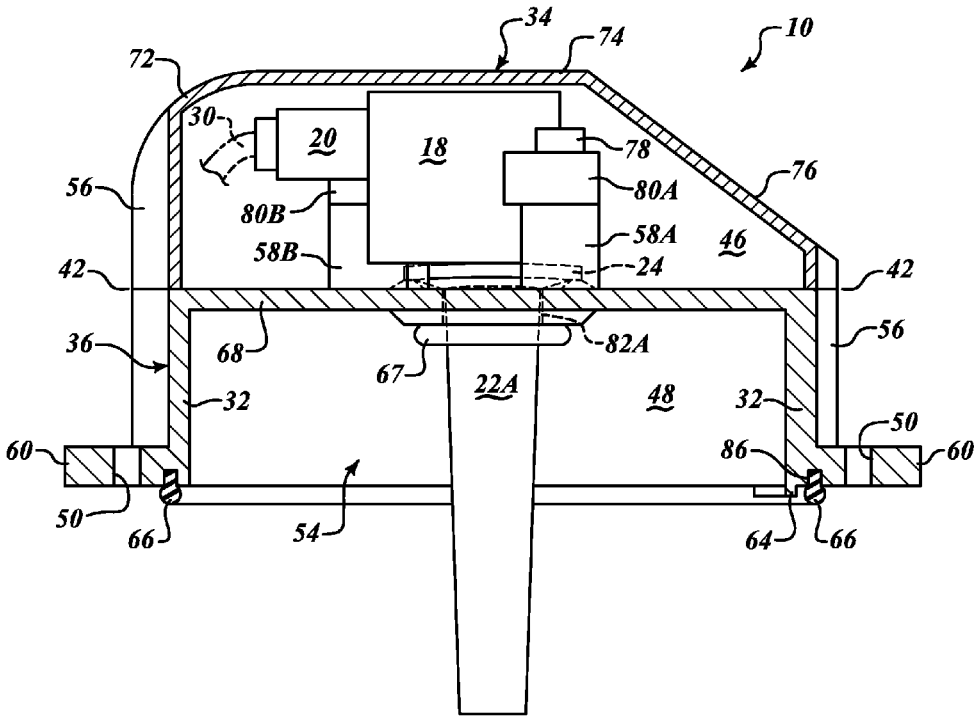
FIG. 3A is a vertical transverse partial section, partial elevation view through the inventive RAC assembly of FIGS. 1 and 2 along the lines 3-3 of FIG. 2 in the fully assembled condition, showing a coil mounted on studs and spark plug boots projecting through apertures in the transverse horizontal partition wall, the bottom mounting flanges and marginal seal assembly as seated in the peripheral groove.

FIG. 3A is a transverse section view along the line 3-3 of FIG. 2 showing the coil 18 mounted in the dry, upper coil chamber 46 formed by the lid 34 and the top of the transverse horizontal partition wall 68. Below the dry coil chamber 46 is the wet rocker arm chamber 48 which is isolated by the horizontal partition wall 68 that extends transversely between all upstanding vertical side walls 32.

The upper face of the partition wall 68 is provided with four pairs of vertical threaded bosses 58 to which the coil brackets are secured. In addition, four pairs of boot apertures 82 are provided in the partition wall 68, through which the coil boots 22 projecting downwardly to receivingly engage and sealingly surround the tops of the igniters (not shown). The open bottom marginal edge of the continuous vertical side wall 32 terminates in a groove 86 that receives a flanged, continuous marginal sealing ring 66 to prevent oil leak.

A partial lip 64 extends downwardly from the outboard marginal edge of the side wall 32. This lip spans from one short transverse (curved) end wall 54, along the outboard wall (on the right in the figure) and terminates in a corresponding location at the other transverse end wall.

This lip engages a groove in the head, assisting in centering the RAC assembly properly on the head. Thus, in the inventive RAC assembly, the "wet" rocker arm chamber 48 is isolated from the "dry" electronic coil chamber 46, yet each can be serviced independently.

Figure 3B:
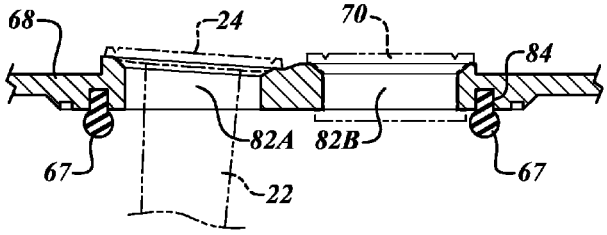
FIG. 3B is a enlarged section view taken along the center line, CL, at the boot apertures along lines 3B-3B of FIG. 2, showing the fitting of the under-seal and an optional boot aperture plug used in the case of standard engines.

FIG. 3B is an enlarged section view along lines 3B-3B of FIG. 2 showing the detail of the boot plug apertures 82A, 82B, the sealing groove 84 on the underside of the transverse partition wall 68 and the corresponding lip on the top face of the transverse partition wall. A flanged, figure-8 sealing ring 67 fits in the groove 84. The upper lips engage grooves in the bottom face of the boot flanges 24A, 24B (see FIG. 2). In addition, shown in phantom, is a sole plug 70 that is inserted in one of the two apertures, aperture 82B being shown by way of example, when the inventive RAC assembly is used in a standard engine which has only one igniter per cylinder. Thus, only one igniter lead and boot 22 is needed, and the spare boot aperture hole is plugged with the grommet-type plug 70. Note one of the boots may be tilted, as shown on the left of FIG. 3B, to provide proper clearance and alignment with the respective igniter it feeds.

Figure 4:
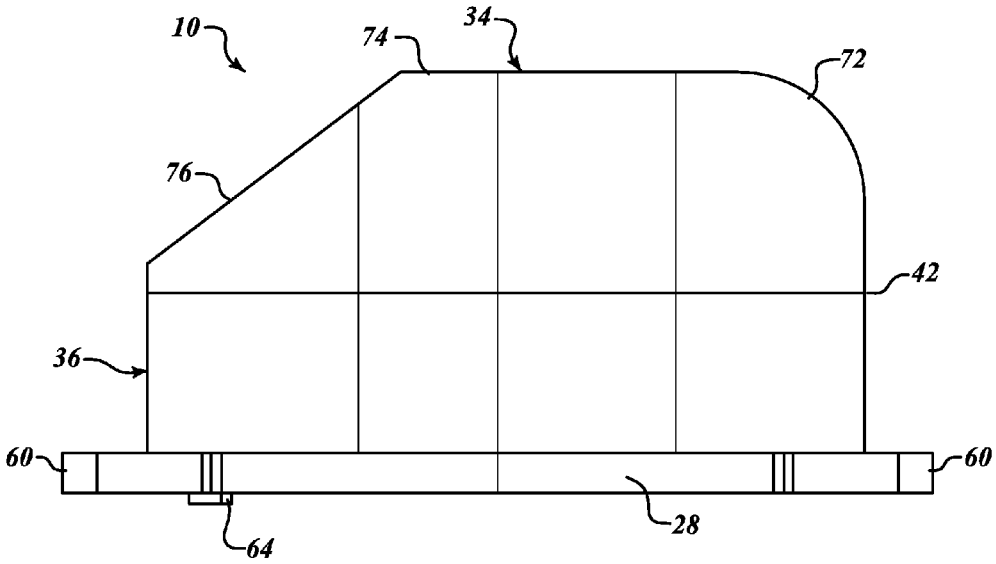
FIG. 4 is an end elevation view of the entire inventive RAC unit, as assembled, showing the lid, mounted on the lower rocker arm chamber, the lower marginal seal being omitted from this view to show the location of the alignment lip along the outboard portion of the lower marginal edge.

FIG. 4 shows in elevation the opposite end of the inventive RAC assembly 10, with parts corresponding to the section view of FIG. 3A, except that the perimeter seal 66 has been omitted. In addition, note the curved shoulder 72, the flat top 74 and the angled face 76 in both FIGS. 3 and 4. Note that in the orientation mounted on the engine, see FIG. 1, the angled face 76 is oriented vertically, in the case of a 90° V8 engine. The angled face terminates above the parting line 42 for good seating on the transverse horizontal partition 68, while at the same time provides sight lines and vertical clearance on the outboard side of the engine for physical access other parts in the vehicle engine compartment, e.g., the exhaust mainfold 26.

Figure 5:
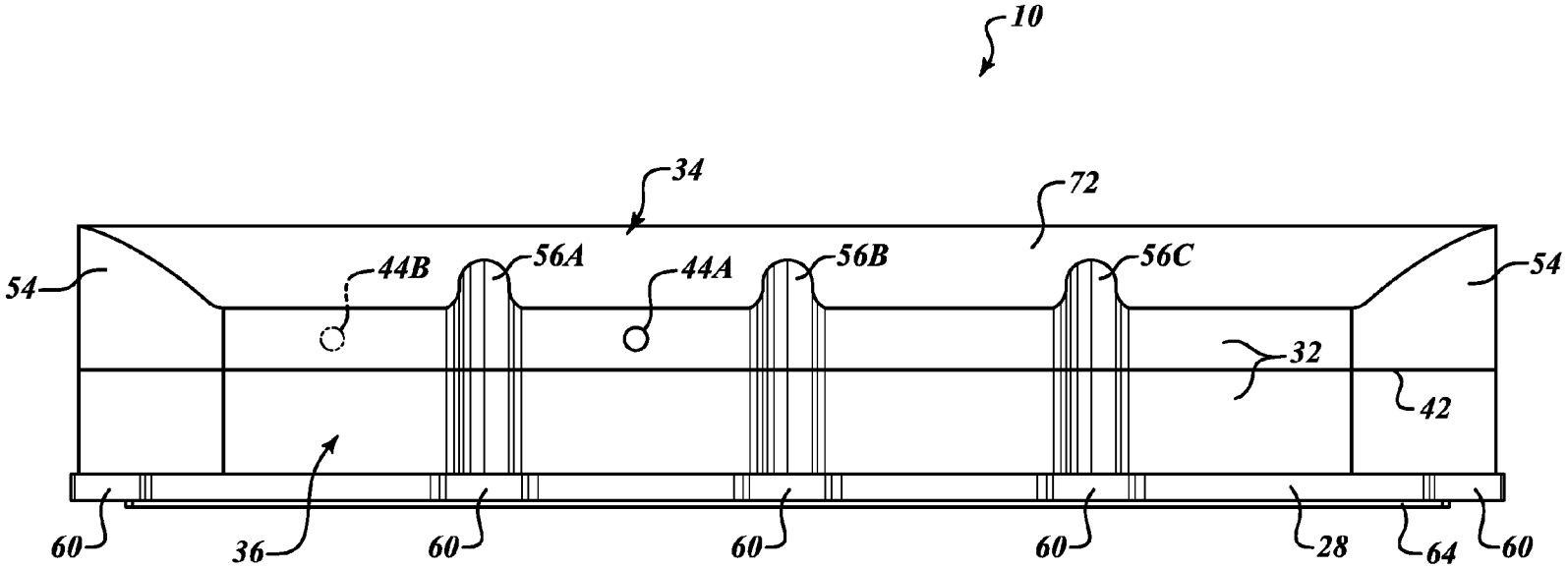
FIG. 5 is a side elevation view of the entire inventive RAC unit, as assembled, from the inboard side, showing a preferred and alternate location of the input coil power supply aperture, the lower marginal seal being omitted from this view to show the location of the alignment lip along the outboard portion of the lower marginal edge.

FIG. 5 is a side elevation view from the inboard side of the inventive RAC assembly 10, again with the perimeter seal omitted. In this view, note that the coil power supply lead aperture 44A in the side wall 32 of the lid 34 is disposed between the first and second vertical socket grooves 56A and 56B. However, in the alternative, the aperture may be located between an end 54 and the first (or third) socket groove 56A (or 56C) as desired for wire harness routing.

Figure 6:
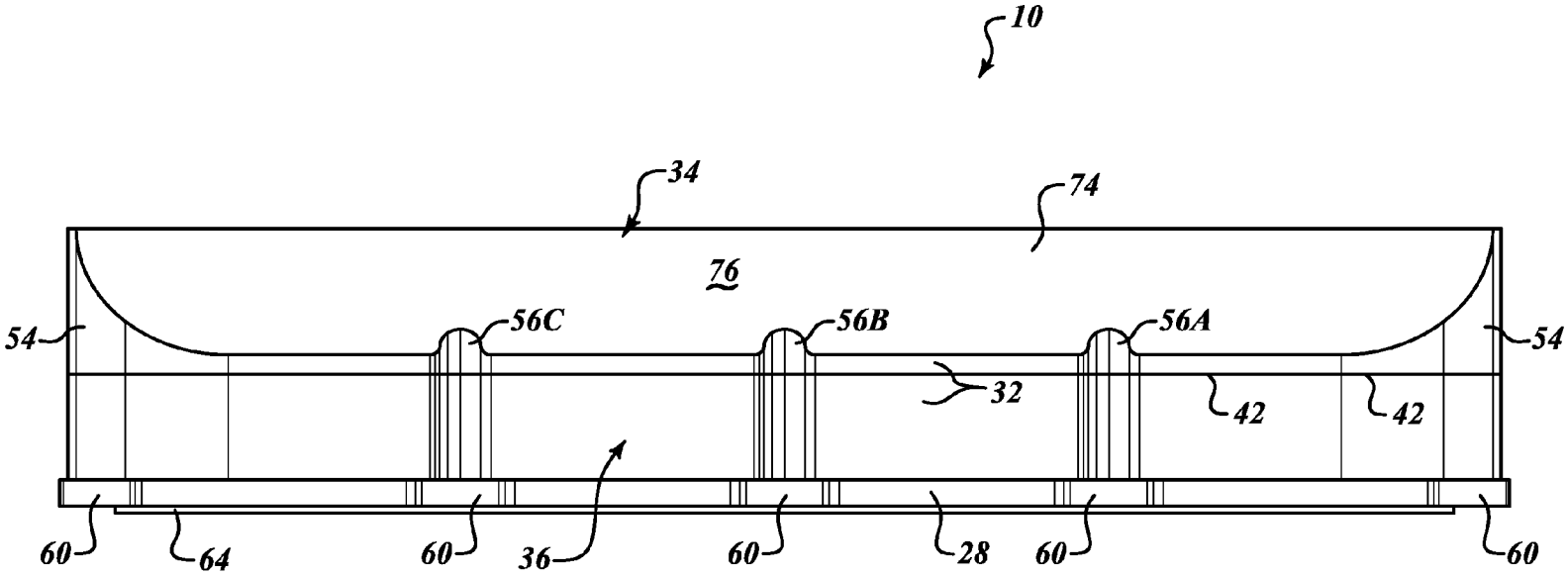
FIG. 6 is a side elevation view of the entire inventive RAC unit, as assembled, from the outboard side, the lower marginal seal being omitted from this view to show the location of the alignment lip along the outboard portion of the lower marginal edge.

FIG. 6 is a side elevation view from the outboard side of the inventive RAC assembly 10, again with the perimeter seal omitted. In this view, note the clearance angled face 74 terminates close to the parting line 42, and there are no apertures for input leads. The lip 64 is closest to this side wall 32, and extends from the lower marginal edge thereof, below the flange 28.

Figure 7:
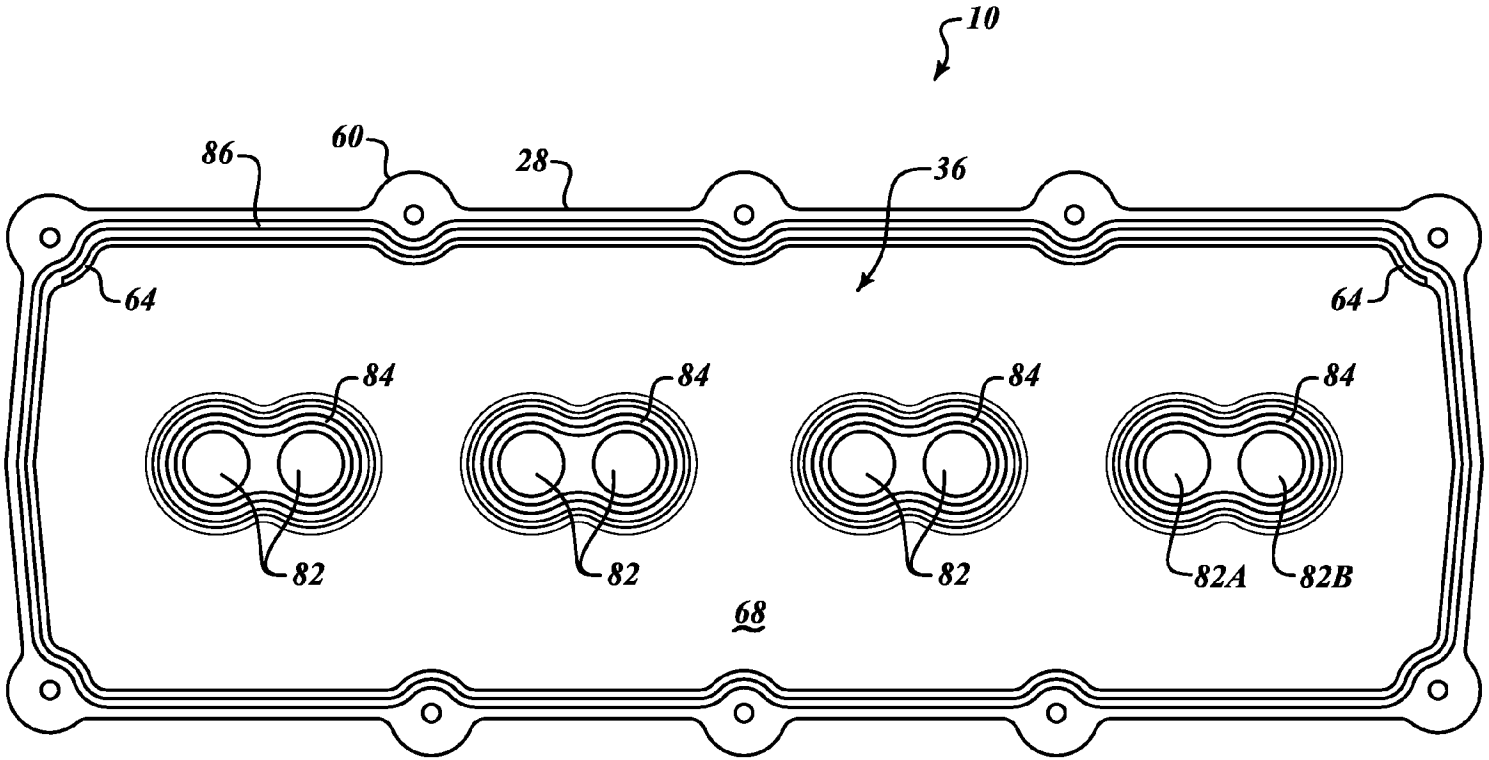
FIG. 7 is a bottom plan view of the underside of the inventive RAC unit, showing the dual spark plug boot holes and the surrounding FIG. 8 grommet grooves.

FIG. 7 is a bottom plan view of the inventive RAC assembly 10, again with the perimeter seal omitted. In this view, note that the coil mounting bosses do not project through the underside (facing the viewer) of the transverse horizontal partition wall 68. In addition, one or more grooves 84, in concentric figure-8 layout surround the paired apertures 82 to assist in sealing the boots 22 via the seal 67 (not shown; see FIGS. 3A and 3B) or plugs 70 (see FIG. 3B), as the case may be. The perimeter groove 86 receives the flange of the sealing ring (not shown), securing it in place. Note the extend of the alignment flange 64, extends from adjacent the juncture of the end walls with the side walls along the outboard lower margin (the upper edge in this view).

Figure 8:
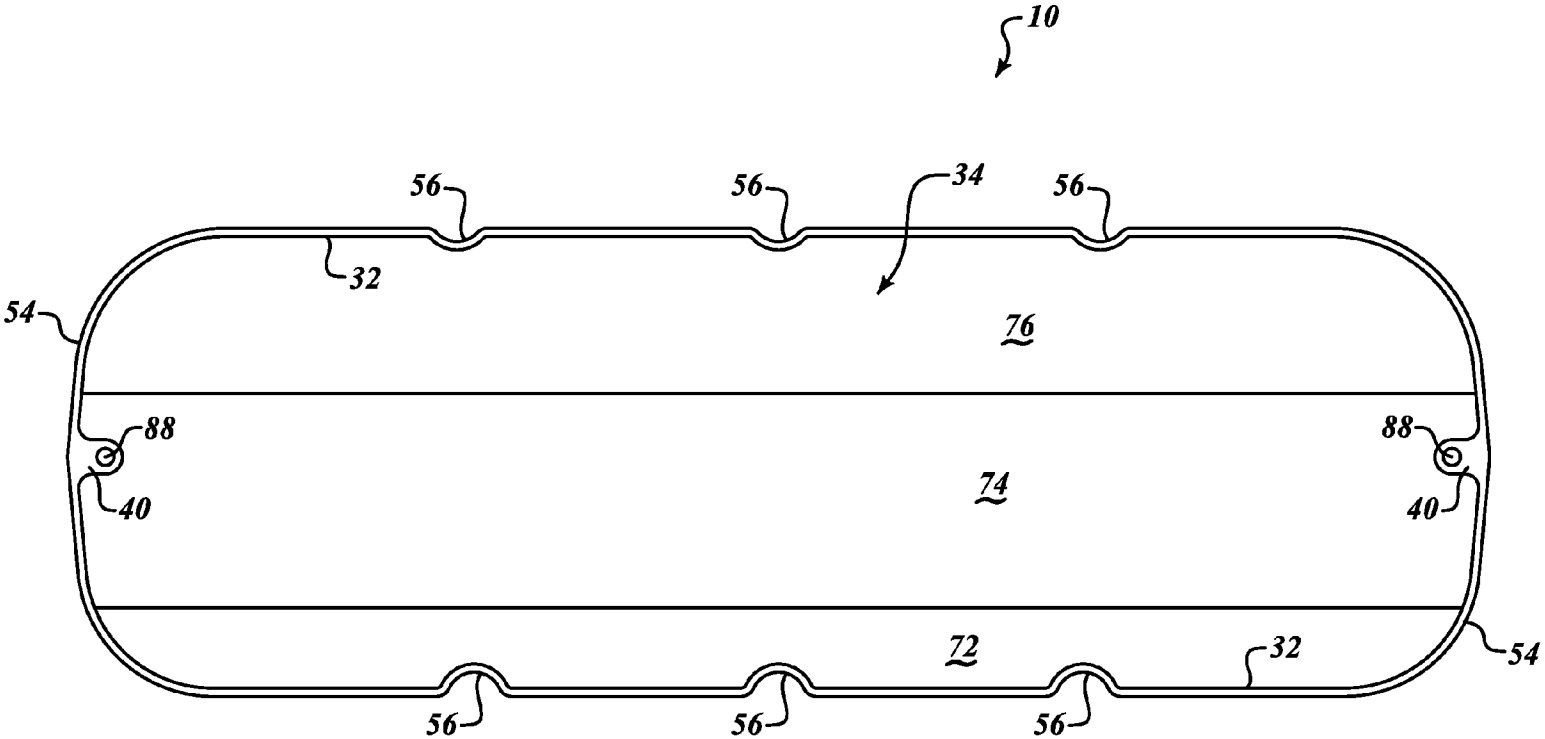
FIG. 8 is a top plan view of the top of the inventive RAC unit showing the bores adjacent opposite ends for receiving screws to secure the lid to the lower chamber.

FIG. 8 is a plan view of the inner face of the cover 34, with the outboard side wall 32 at the top. Note the respective angled face 76, the flat top 74, and the curved shoulder 72. The socket recess grooves 56 extend to both longitudinal side walls which are indented to provide the groove configuration. Each curved end wall 54 includes an inwardly projecting web 40 through which the hole 88 is provided for the mounting screw 38 to pass (see FIG. 1) for securing the lid 34 to the lower body 36 via threaded hole 62 (FIG. 1).

Thus, the invention is directed to an improved, enclosed RAC assembly for internal combustion engines having Distributorless Ignition Systems, that is mountable to the head of an internal combustion engine, comprising an elongated, longitudinally extending, open-bottom shell housing, having generally an inverted-U shape in vertical cross-section, a pair of spaced, vertical, longitudinally extending side walls that are joined at each end by curved end walls that are continuations of and join the respective side walls, the bottom of said side walls being flanged and provided with a continuous perimeter seal to sealingly engage the head of an internal combustion engine in mounted position; the shell housing has a horizontal partition wall spanning between said vertical side walls and is disposed vertically medially between the open bottom and a concave shell top or lid of said housing; the horizontal partition wall divides the housing into an upper, dry coil chamber and a lower, wet rocker arm chamber to provide an enclosed "coil-over" mounting arrangement; the upper coil chamber is a removable lid that matingly engages the partition wall at the side walls, and includes one or more apertures in one longitudinal side wall through which coil power supply wire(s) are may be fed to coils mounted in the upper, dry coil chamber; a plurality (4 per RAC assembly) of threaded mounting bosses project upwardly in the coil chamber from the partition wall to receive a plurality of coils; disposed between the bosses is a pair of apertures in the partition wall communicating between the dry coil chamber and the wet rocker arm chamber just below, the apertures being configured to receive boots from the coils to provide output leads to igniters of the engine; in cases where only a single igniter is provided per cylinder, one of each pair of holes may be plugged; the inner face of the lid at each end includes a web having a bore to permit pass through of a securing screw so that the lid is secured to coordinate, threaded holes in the lower body; the bottom marginal wall of the lower body is grooved to receive a flanged, continuous marginal seal member.

Additional features include the mounting flange including ears having holes for pass through of mounting bolts to mount the RAC assembly to the head. The longitudinal side walls include vertical grooves coordinate with the mounting holes of the base flange to permit socket clearance. An alignment lip is disposed extending from end wall to end wall along the outboard lower marginal edge of the lower body that is configured to mate with a groove in the engine head. This assures proper alignment of the inventive RAC assembly on the head. The top, outer surface of the lid may be contoured, preferably with a rounded inboard shoulder and an outboard sight line and clearance angled face that is oriented vertically when the inventive RAC is mounted on a 90° V8.

INDUSTRIAL APPLICABILITY

It is clear that the inventive RAC assembly of this application has wide applicability to the automotive industry, namely to hemi engines having Distributorless Ignition Systems. The inventive RAC assembly clearly provides simplicity of mounting and independent access of the coils, the rocker arms and the igniters. The removable lid permits access to all coils for independent checking, replacement or servicing simply by removal of two screws, while the rocker arm chamber remains intact and undisturbed. In addition, the coils are maintained dry and protected by not being in the wet chamber along with the rocker arms. Thus, the inventive RAC assembly has the clear potential of becoming adopted as the new standard for apparatus and methods of co-mounting coils of hemi engine DIS systems and rocker arm covers in a single, robust unit.

It should be understood that various modifications within the scope of this invention can be made by one of ordinary skill in the art without departing from the spirit thereof and without undue experimentation. For example, the longitudinal base housing can have a wide range of configurations to provide different hemi engine head designs the functionalities disclosed herein. In addition, the improved, inventive RAC unit may be fitted with one or more conduits, e.g., one at each end, with one fitted to function as an oil fill tube and the other fitted with a PCV valve. In the alternative, a single dual function conduit may be provided. This invention is therefore to be defined by the scope of the appended claims as broadly as the prior art will permit, and in view of the specification if need be, including a full range of current and future equivalents thereof.

The invention claimed is:

1. A rocker arm and ignition coil cover assembly for engines having hemispherical cylinder heads comprising in operative combination:

a) a single, generally elongated, stadium-shaped in plan view, open bottom housing having a longitudinal center line as seen in plan view, and generally comprises an inverted U-shape in cross-sectional elevation with vertical longitudinal side walls;

b) a generally horizontal partition wall spanning internally between said vertical side walls to define a wet lower rocker arm and igniter chamber below a lower surface of said partition wall, and a dry coil chamber above an upper surface of said partition wall;

c) said side walls include a horizontal parting line adjacent the top of said partition wall to define a cover that is generally D-shaped, concave down in transverse cross section to form said coil chamber;

d) a side wall of said coil chamber cover includes at least one aperture for an input power lead for at least one ignition coil assembly mountable in said coil chamber;

e) said horizontal partition wall upper surface including paired, spaced upstanding bosses having threaded holes centrally thereof for mounting said at least one ignition coil assembly in said coil chamber; and f) said internal horizontal partition wall including a plurality of paired apertures disposed spaced along, and bisected by said longitudinal center line to receive therethrough at least one igniter boot having an igniter coil output lead.

2. Rocker arm and ignition coil cover assembly as in claim 1 wherein said coil chamber cover is securable to said horizontal partition wall by at least one pair of threaded bolts passing through apertures in said cover to engage threaded holes in said horizontal partition wall, each of said pair of apertures being disposed adjacent a transverse end of said cover assembly.

3. Rocker arm and ignition coil cover assembly as in claim 1 wherein said side walls of said open bottom rocker arm and igniter chamber terminate in a laterally extending horizontal flange, and includes a sealing member retained in a peripheral groove in the bottom face of said flange, said sealing member sealing said cover assembly to a head of an engine in operation.

4. Rocker arm and ignition coil cover assembly as in claim 3 wherein at least one longitudinal side wall inner margin includes a vertically extending depending lip extending below said flange and disposed to engage a groove or shoulder on said engine head to assist in aligningly orienting said cover assembly for proper fitting on said engine head.

5. Rocker arm and ignition coil cover assembly as in claim 4 wherein said depending lip extends partly around each curved end wall.

6. Rocker arm and ignition coil cover assembly as in claim 3 wherein said lateral flange includes a plurality of laterally extending ears having apertures for receiving therethrough bolts for securing said cover assembly to said engine head.

7. Rocker arm and ignition coil cover assembly as in claim 6 wherein said longitudinal side wall includes a plurality of vertical clearance grooves aligned with said ears and bolt apertures to permit clearance of sockets for proper tightening of said cover-securing bolts.

8. Rocker arm and ignition coil cover assembly as in claim 1 wherein the bottom surface of said horizontal partition wall includes a groove surrounding each pair of spaced boot apertures in a generally figure-8 configuration for sealing said boots passing through from said coil chamber to said rocker arm and igniter chamber.

9. Rocker arm and ignition coil cover assembly as in claim 8 wherein the top surface of said horizontal partition wall in the area surrounding each pair of spaced boot apertures is configured to seatingly receive flanges of at least one of a boot and an aperture plug, said aperture plug being used in standard engine configurations wherein only one igniter is employed per cylinder.

10. Rocker arm and ignition coil cover assembly as in claim 1 wherein said cover assembly includes four pairs of bosses to receive four individual coils in said coil chamber, one coil for each of four cylinders corresponding to a bank of cylinders of a V-8 hemi engine.

11. Rocker arm and ignition coil cover assembly as in claim 1 wherein said coil chamber cover, as seen in transverse cross-section includes side walls of different height, a first side wall being taller than a short second side wall, said first side wall including said at least one input power lead aperture.

12. Rocker arm and ignition coil cover assembly as in claim 11 wherein said first side wall is disposed, as mounted for operation on an engine having a centerline, closest to said engine center line.

13. Rocker arm and ignition coil cover assembly as in claim 12 wherein said coil chamber cover includes a flat section extending longitudinally and laterally outwardly away from said longitudinal center line of said assembly to said short second side wall at approximately a 45° angle, so that upon mounting for operation on a V-8 hemi engine, said flat section is relatively vertical and provides access clearance for other engine components and servicing.

* * * * *